US007212178B2

(12) United States Patent
Ishii et al.

(10) Patent No.: US 7,212,178 B2
(45) Date of Patent: May 1, 2007

(54) METHOD AND APPARATUS FOR DRIVING A DISPLAY PANEL

(75) Inventors: Makoto Ishii, Miyazaki (JP); Tomokazu Shiga, Kawasaki (JP); Shigeo Mikoshiba, Tokyo (JP); Jurgen Jean Louis Hoppenbrouwers, Eindhoven (NL); Dirk De Bruin, Eindhoven (NL); Bart Andre Salters, Eindhoven (NL); Roel Van Woudenberg, Eindhoven (NL); Siebe Tjerk De Zwart, Eindhoven (NL); Ruediger Johannes Lange, Eindhoven (NL)

(73) Assignee: Koninklijke Philips Electronics N. V., Eindhoven (NL)

( * ) Notice: Subject to any disclaimer, the term of this patent is extended or adjusted under 35 U.S.C. 154(b) by 426 days.

(21) Appl. No.: 10/479,086

(22) PCT Filed: May 30, 2002

(86) PCT No.: PCT/IB02/01991

§ 371 (c)(1),
(2), (4) Date: Nov. 25, 2003

(87) PCT Pub. No.: WO02/097775

PCT Pub. Date: Dec. 5, 2002

(65) Prior Publication Data

US 2004/0155835 A1 Aug. 12, 2004

(30) Foreign Application Priority Data

May 30, 2001 (EP) ..... 01202045
Jun. 1, 2001 (EP) ..... 01202134

(51) Int. Cl.
*G09G 3/28* (2006.01)

(52) U.S. Cl. ..... 345/66; 345/63; 345/67; 315/169.4

(58) Field of Classification Search ..... 345/60, 345/61, 41, 63, 66–68; 315/169.1–169.4
See application file for complete search history.

(56) References Cited

U.S. PATENT DOCUMENTS 6,407,510 B1 * 6/2002 Yoo et al. ..... 315/169.4
6,492,776 B2 * 12/2002 Rutherford ..... 315/169.1
2002/0070906 A1 * 6/2002 Kawasaki et al. ..... 345/60

FOREIGN PATENT DOCUMENTS

JP 2000293138 10/2000
JP 2000293138 A * 10/2000
WO WO 00/43980 7/2000

OTHER PUBLICATIONS

JP 2000293138 A English translation.*

* cited by examiner

*Primary Examiner*—Amr A. Awad
*Assistant Examiner*—Yong Sim

(57) ABSTRACT

The invention provides for a method and display apparatus (10) having driving circuitry for driving a display panel (24) having a plurality of addressable discharge cells (26) driven by display pulses (DP), including the steps of applying data pulses (DAP) during the time interval between display pulses (DP) and characterized by the step of priming charges for each of the discharge cells (26) by means of the reset discharges so as to reduce the required data voltage, and in particular such a method wherein one TV-field period ($T_F$) is divided into a plurality of sub-fields (SF) all of which are of substantially equal time durations.

13 Claims, 9 Drawing Sheets

FIG. 3 [PRIOR ART]

METHOD AND APPARATUS FOR DRIVING A DISPLAY PANEL

The present invention provides for a method and apparatus for driving a display panel having a plurality of addressable discharge cells driven by display pulses and which includes the application of address pulses during the time interval between display pulses.

Although the picture quality offered by, for example, Plasma Display Panels (PDPs) has improved since their initial development, the level of quality is still considered insufficient when compared with that of Cathode Ray Tube displays (CRTs). Among such limitations is an insufficient gray scale capability at low luminance levels and the prevalence of motional artifacts. Also a limited choice of gamma characteristics is becoming more of an issue as higher picture quality is pursued.

It is considered that an effective measure of overcoming these difficulties is to seek to increase the number of sub-fields used when driving the display.

Methods of the above-mentioned nature are known from WO-A-00/43980 and JP-A-2000293138. Both these documents disclose an addressing scheme commonly known as Address While Display (AWD) which, unlike the more conventional Address Display-period separation scheme (ADS), utilizes the time duration between display pulses.

Such known methods are however limited with regard to the manner in which they can overcome the disadvantages discussed above.

It is an object of the invention to provide an improved display panel driving. The invention is defined by the independent claims. The dependent claims define advantageous embodiments.

According to a first aspect of the present invention, there is provided a method as defined above, characterized by the step of generating priming charges for each of the discharge cells by means of reset discharges so as to reduce an amplitude of the data pulses.

In combining an AWD scheme and a low-voltage addressing scheme fast switching speeds for the address discharges can be achieved. The invention can advantageously therefore embody a technique of providing, for example 208, sub-fields in an NTSC format with 480 horizontal lines at double scan.

The priming effect of the reset discharges, generated by reset pulses, assists with limiting the reset-scan period and narrows the address pulses and this serves to enable a high number, e.g. 208, of equal-length sub-fields for a display panel to be employed. The use of a grouped AWD scheme further enhances this aspect of the invention. Gray tones are made available by means of an erase address technique. Cells are turned on, so start emitting light after the reset pulses. Depending on a desired light output of that cell, the cell is turned off very shortly after the reset pulses or after one or more subfields by addressing that cell by applying data pulses. These data pulses create address discharges, which "erase" a cell. Gamma characteristics are possible by varying the number of display pulses in the equal duration sub-fields. Data pulses for a row of discharge cells are applied during the time interval between display pulses applied to that row. However, while the data pulses are applied to that row, display pulses can be applied to other rows of cells.

This invention is particularly advantageous in serving to increase the number of sub-fields that can be employed.

The invention provides for further features serving to ensure that a high number of sub-fields is available for creating the desired gray-levels.

In particular, the display pulses applied immediately after the write pulse create more priming and/or wall charges within a cell, thereby improving firing of the cell after the address period. By delaying the address period of each subfield by at least one cycle of the display pulses, no extra time is needed for applying these display pulses, so the available number of subfields remains the same.

In an alternative embodiment, the address period is delayed in such a way that it ends shortly (in the order of magnitude of a few microseconds) before the first display pulse in the subfield. This allows a wider write pulse, resulting in an improved firing after the address period.

Furthermore, large area flicker is reduced by introducing interlace. By spacing apart the start of the light emission of odd and even rows by an amount of half a TV-field period, the effect is that the frame rate is actually doubled, when averaging the light emission over a large area. At this higher frame rate the flicker is strongly reduced.

In particular, the invention is advantageous in providing for scan pulses with a width that serves to allow for a relatively high number of sub-fields to be employed.

Particular advantages arise since the higher the number of sub-fields employed the less the influence of motion artifacts.

In general it should be appreciated that the low voltage addressing allows a very small scan pulse width of for example 0.33 micro-seconds, whereas the grouped AWD technique allows a driving scheme serving to further provide for a very high number of sub-fields.

However, it should be appreciated that in one aspect the invention does not necessarily employ a pure address while display scheme, but rather a mixture of AWD and the standard ADS scheme or a pure ADS scheme. A particular advantage as discussed is that very short addressing times are possible.

The driving of, for example, AC-PDPs with 208 sub-fields can be realized by using a grouped AWD scheme, which combines AWD and low-voltage-addressing techniques. Display pulses can be applied during 99% of the TV-field time and so the invention can provide high picture quality with a wide choice of gamma characteristics.

The invention is are advantageous to reduce Electro Magnetic Interference (EMI). This is achieved by an arrangement of electrodes and drive signals, whereby adjacent electrodes have substantially the same timing of display pulses. By connecting adjacent electrodes at opposite terminals, the currents flowing through the electrodes will have substantially the same waveform, but an opposite polarity. In this way the electromagnetic fields generated by the adjacent electrodes will substantially compensate each other.

The invention is advantageous in serving to simplify the drive arrangement by applying the reset pulse and scan pulses only to the scan electrodes.

The invention defines particularly advantageous limitations on the length of time between reset and write pulses.

The invention allows for a wider operating voltage margin by means of the application of the reset pulse in the line-at-a-time sequence.

The invention advantageously eases requirements on the shape of the reset pulse and can provide for a wider operating voltage margin.

The invention advantageously eases requirements on the shape of the scan pulse.

The invention advantageously provides for a wider voltage margin.

The invention allow for a greater choice of voltages and timing for achieving wider operating margins, and also allow for a wider operating voltage margin and lower peak-to-peak voltage for display, scan, and data electrodes.

These and other aspects of the invention will be apparent from and elucidated with reference to the embodiments described hereinafter.

The invention is described further by way of example only with reference to the accompanying drawings in which.

Figure 4:
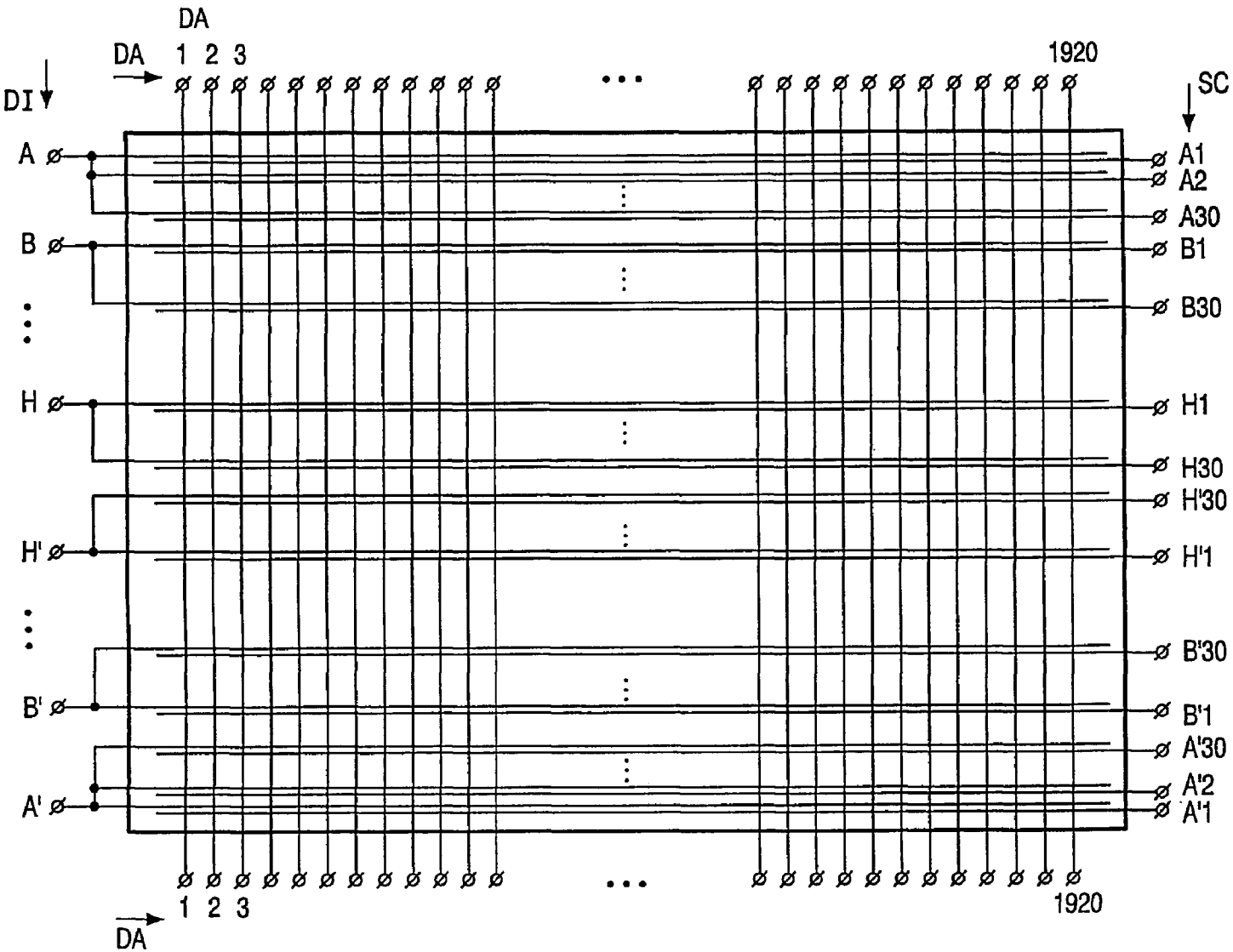
Figure 5:
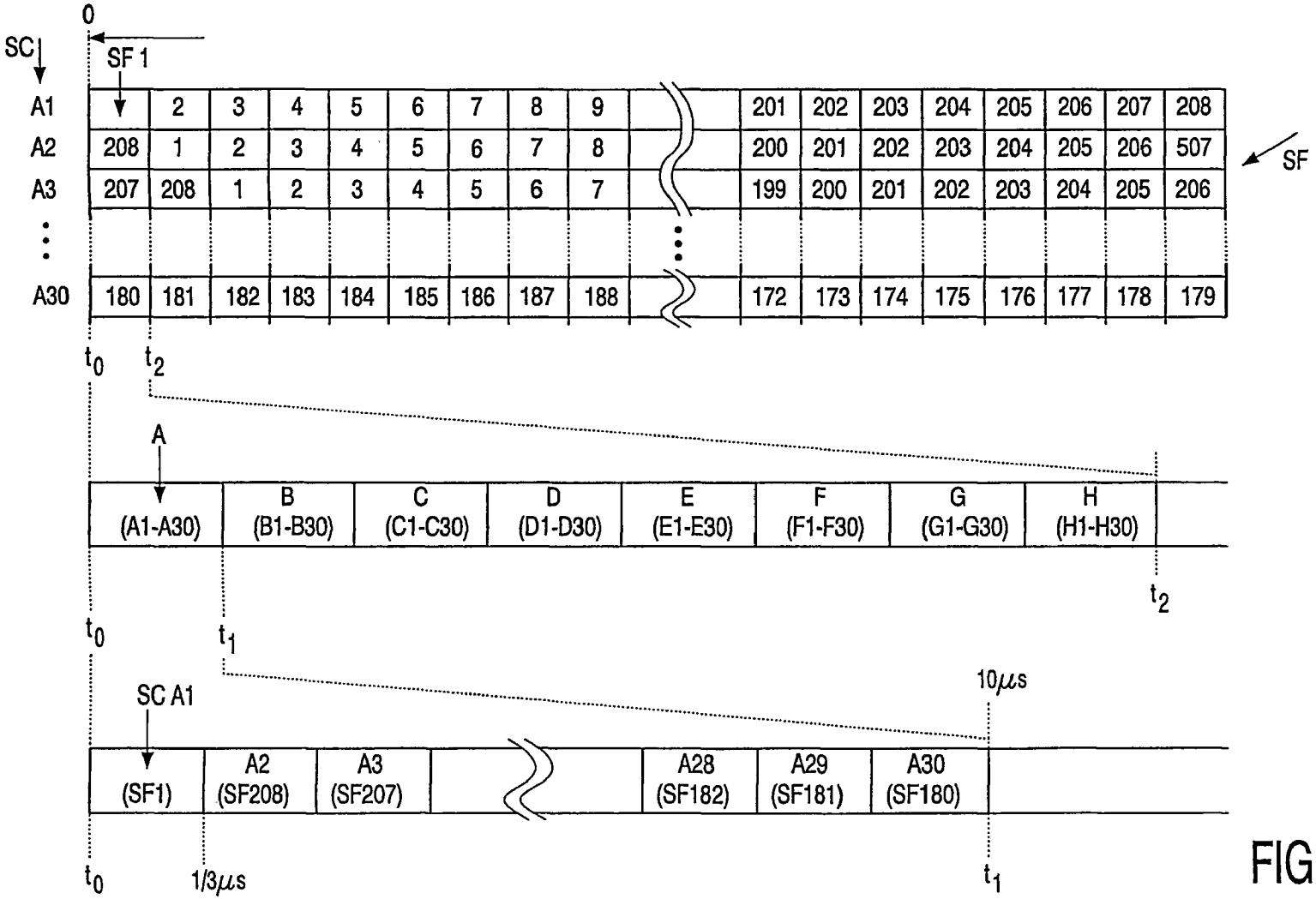
Figure 6:
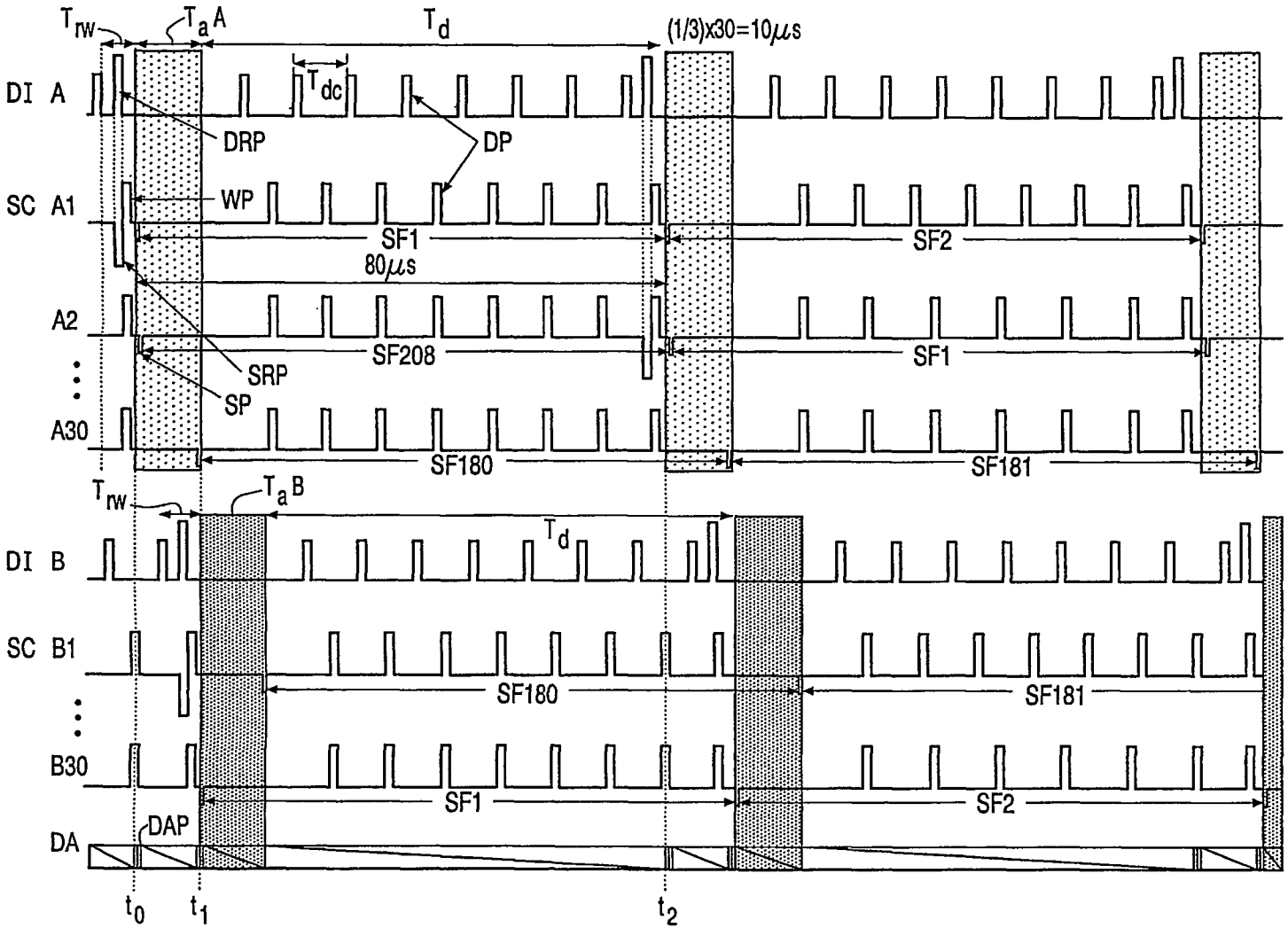
Figure 7:
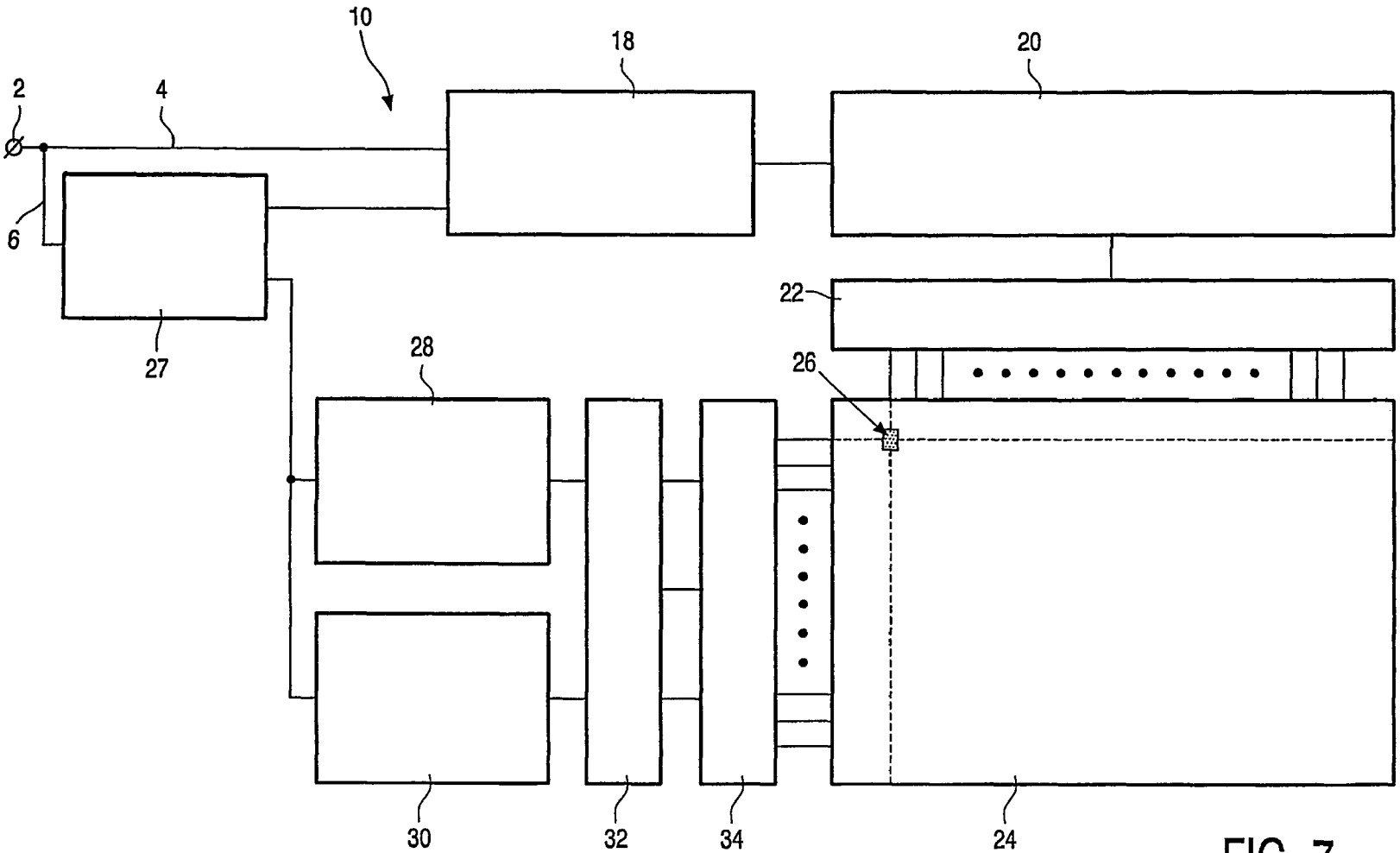
Figure 8:
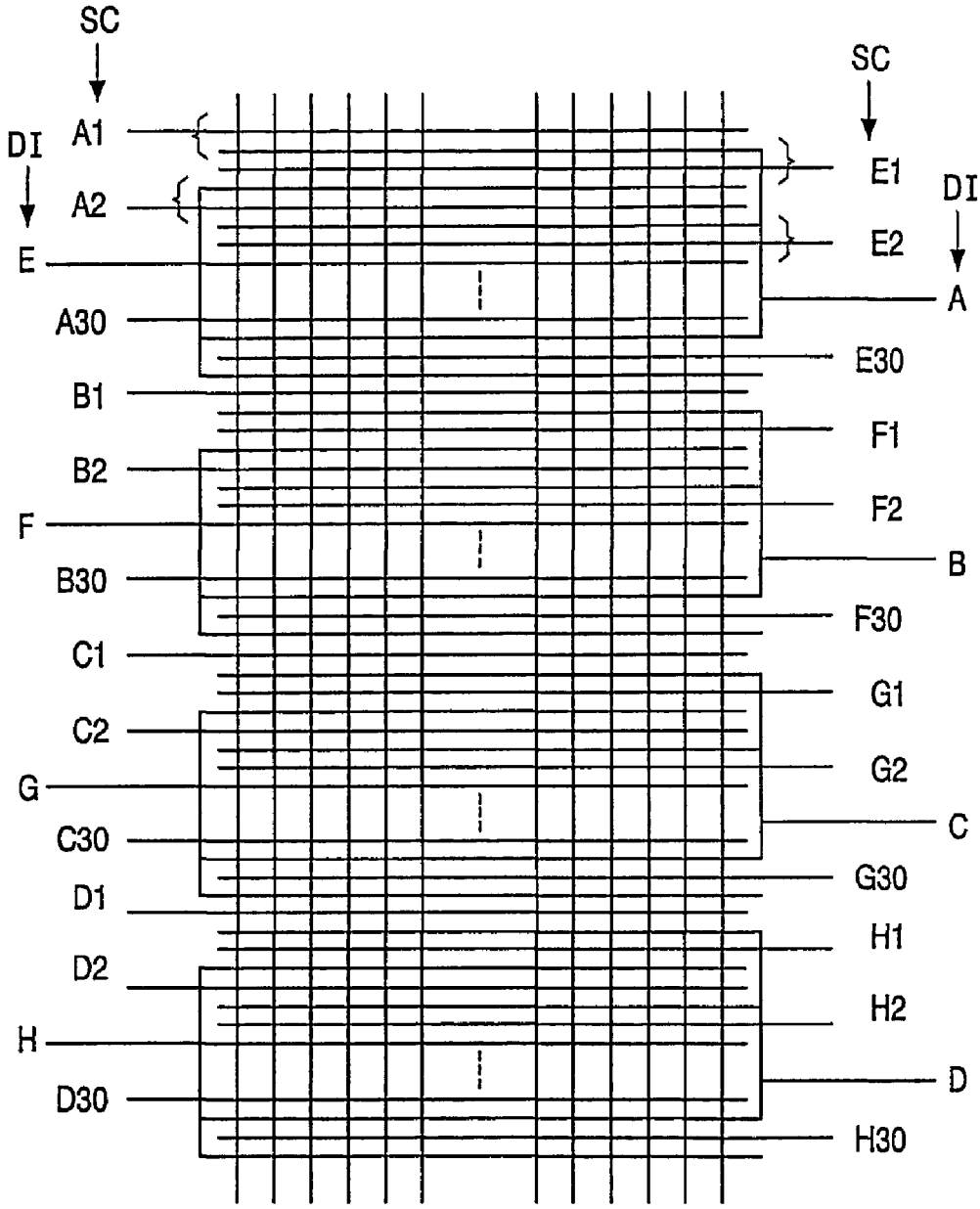

FIG. 4 provides an indication of possible electrode connections for a PDP arranged to be driven in accordance with a method embodying the present invention;

FIG. 5 is an address-timing diagram for a drive scheme embodying the present invention;

FIG. 6 illustrates the voltage waveform for a grouped drive scheme according to an embodiment of the present invention;

FIG. 7 is a block diagram illustrating one embodiment of the apparatus according to the present invention; and FIG. 8 provides an embodiment with electrode connections arranged for lowering EMI.

Figure 9:
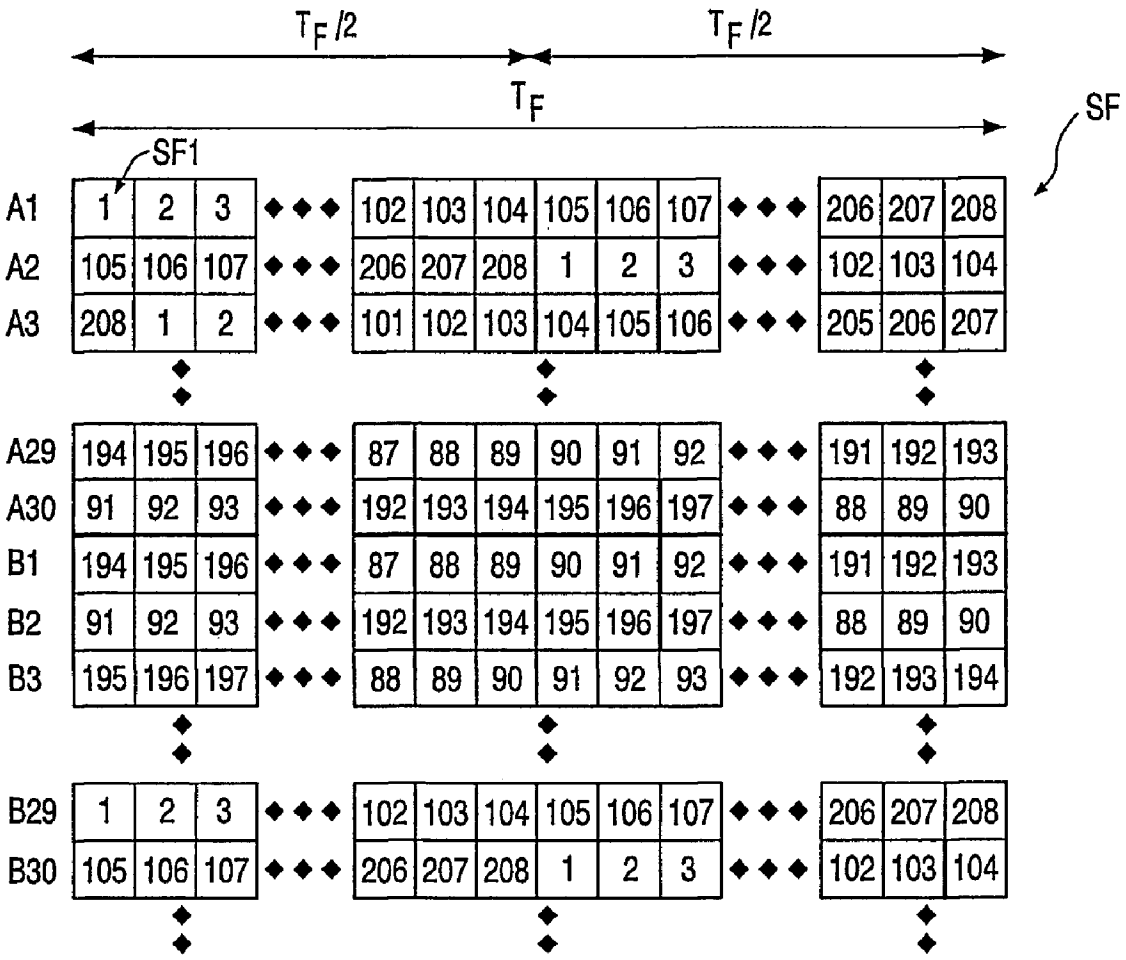

FIG. 9 provides an embodiment of the interlaced AWD scheme resulting in a zig-zag pattern.

Figure 10:
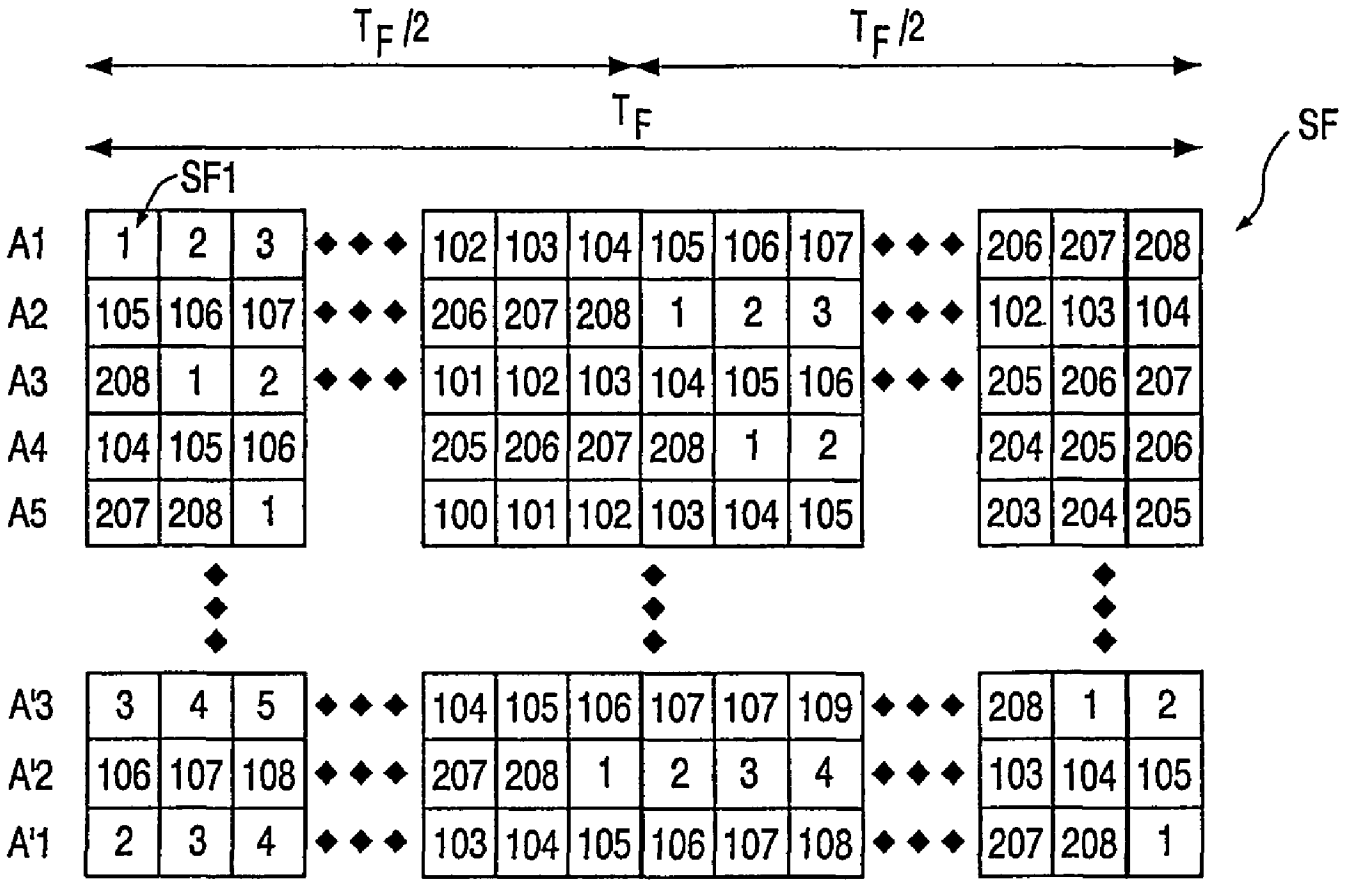

FIG. 10 provides an embodiment of the interlaced AWD scheme resulting in a slanting pattern.

Figure 1:
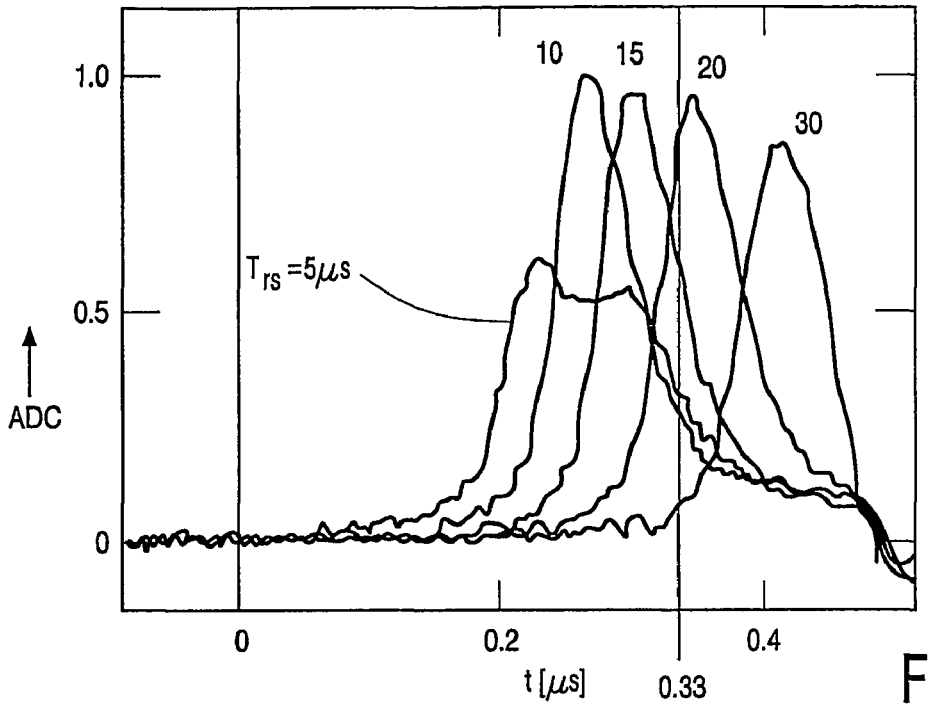
FIG. 1 illustrates address-discharge current waveforms for a variety of periods of separation between reset and address pulses.

FIG. 1 shows the address discharge current waveforms for a PDP three-electrode surface discharge AC panel structure. The structure (shown in FIG. 4) comprises a matrix of discharge cells each having a vertically extending data electrode DA (also called signal electrode), a horizontally extending display electrode DI and also a horizontally extending scan electrode SC. An address discharge is developed between the signal DA and scan electrodes SC while a display discharge is developed between the display DI and scan electrode SC. Alternatively, the signal electrode DA may extend horizontally, and the scan electrode SC may extend vertically.

Time zero in FIG. 1 denotes the time t when the address pulses are applied. The address pulses consist of a scan and a data pulse. The parameter $T_{rs}$ is the time duration between the reset and address pulses. The exemplary measurements illustrated in FIG. 1 were performed using a 21-inch (53.34 cm) diagonal PDP with data pulse voltage Vdata set at 50V and scan voltage Vscan set at −185V. As can be seen, when the parameter $T_{rs}$ is less than 10 μs, the address discharge current ADC shown on a scale with an arbitrary unit almost terminates within 0.33 μs.

Figure 2:
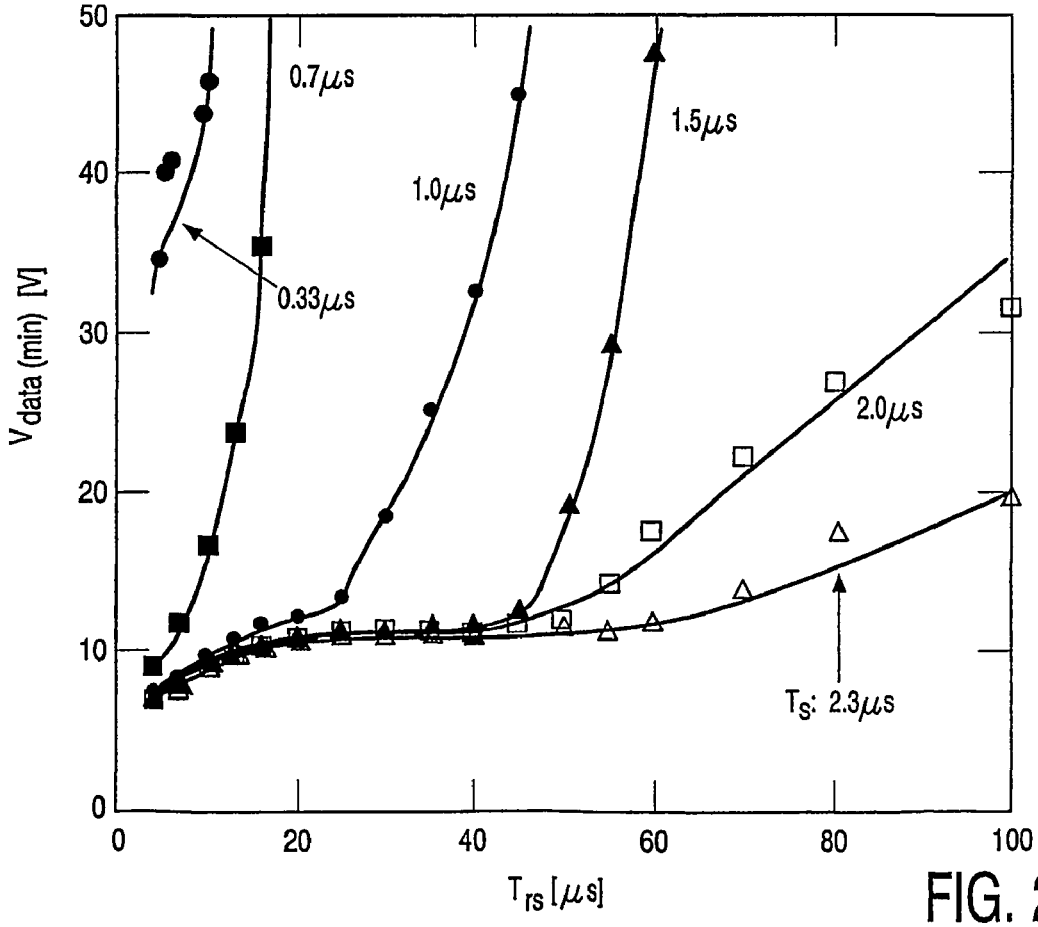
FIG. 2 illustrates minimum data pulse voltages relative to the aforesaid different periods of FIG. 1.

FIG. 2 illustrates minimum data pulse voltages Vdata (min) with respect to the parameter $T_{rs}$ for the scan pulse widths $\tau_s$ varying between 0.33 and 2.3 micro-seconds. The scan voltage Vscan is kept within 10 μs, but this requires the data pulse voltage value to be sacrificed. However, the data pulse voltage Vdata can be reduced further if $T_{rs}$ is made shorter. In the exemplary 208 sub-field operation discussed further here, a scan pulse width $\tau_s$ of 0.33 μs and $T_{rs}$ of 10 μs are chosen.

An alternative is to select about 20 μs for the parameter $T_{rs}$. When taking into account 10 microseconds for the address period and about 1 μs, respectively 2 μs rest periods after the write pulse, respectively the address period, about 7 μs remain for applying a wider write pulse. This reduces the chances that cells also ignite at the negative slope of the write pulse, which could result in improper igniting at the first display pulse following the write pulse.

Figure 3:
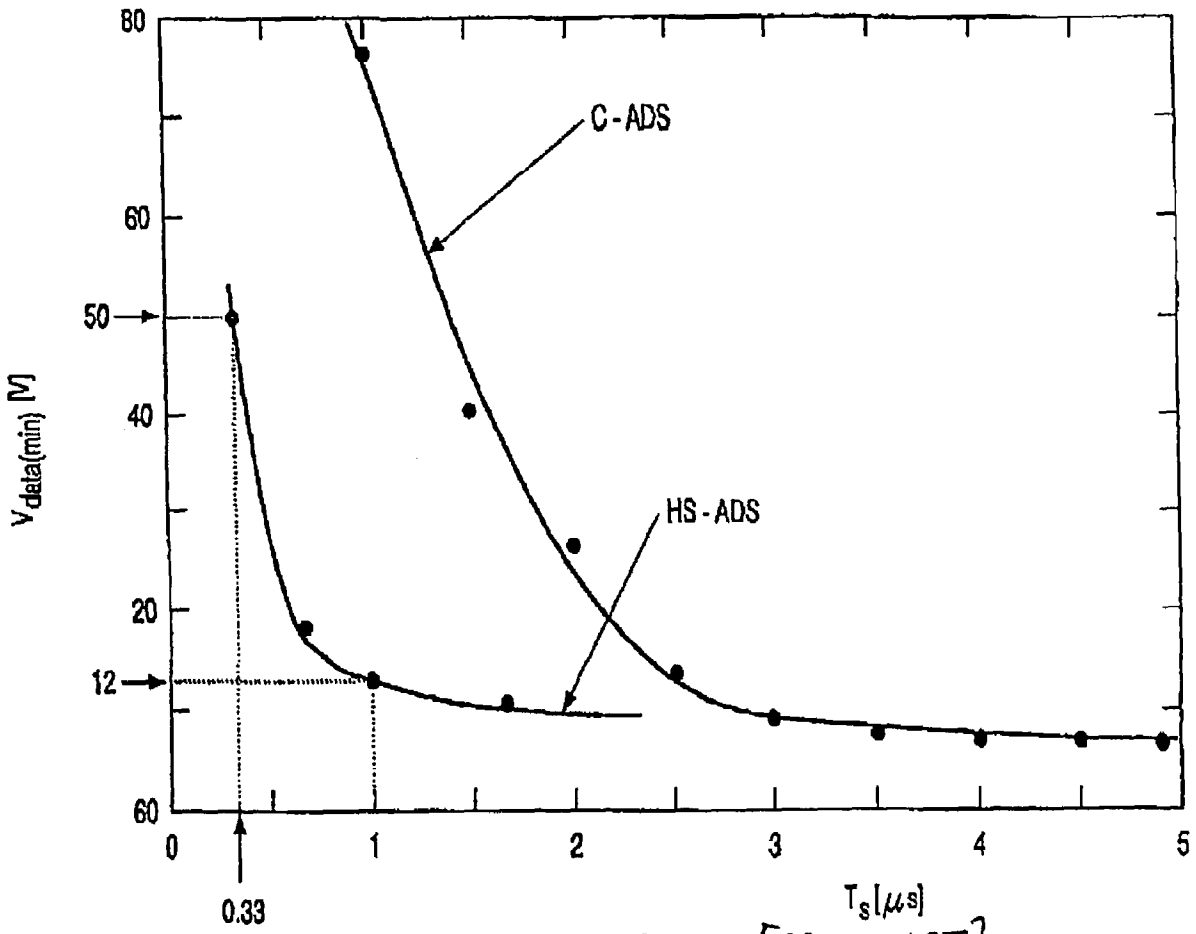
FIG. 3 shows a plot of minimum data pulse voltage against scan pulse width for a conventional ADS scheme.

For comparative purposes, FIG. 3 illustrates the relationship between the minimum data pulse voltage Vdata(min) and scan pulse width $\tau_s$ for a conventional ADS scheme C-ADS and also an ADS scheme HS-ADS offering a low voltage and high speed addressing characteristic. The relationships were obtained from a 21-inch diagonal PDP.

FIG. 4 shows typical electrode connections of a PDP driven according to an embodiment of the present invention. In this particular version, address discharges take place mainly between the scan electrodes SC and data electrodes DA, whereas the display discharges take place mainly between the display electrodes DI and scan electrodes SC. As will be appreciated, the display electrodes are grouped from A to H, respectively from H' to A'. The display electrodes DI grouped from A to H are cooperating with the data electrodes DA numbered from 1 to 1920 at one side of the panel. The display electrodes DI grouped from H' to A' are cooperating with the data electrodes DA numbered from 1 to 1920 at the other side of the panel. With such a double scan arrangement simultaneous addressing of a row of the groups A to H and a row of the groups H' to A' is possible. All the display electrodes DI belonging to an identical group are connected to a single driver circuit.

FIG. 5 illustrates a timing diagram for addressing the PDP. In this drive scheme, the scan pulses, which are 0.33 micro-seconds wide, can be applied throughout the TV-field period $T_F$ of 1/60 seconds. With, for example $(10^6/60)/(1/3)$ =50,0000 scan pulses in a TV-field period $T_F$, and with 240 lines to be scanned in a panel for the double scan mode, the number of sub-fields SF can be as many as 50,000/240=208. The length of each sub-field SF therefore becomes $(10^6/60)/208$=80 μs. In the illustrated embodiment of the invention, all of the sub-fields SF can therefore have an identical length of 80 μs.

Since the longest $T_{rs}$ is 10 μs, each sub-field provided of 80 μs can be divided into 80/10=8 groups A to H each 10 μs long. There are then 240/8=30 scan lines in each group A–H. Scan electrodes A1–A30 as shown in FIG. 4 for instance, belong to the group A and are addressed during the period t0–t1 of FIG. 5.

FIG. 6 illustrates the voltage waveforms for the drive scheme according to a particularly advantageous embodiment of the invention. The time notations t0, t1 and t2 correspond to those of FIG. 5. Display pulses DP are applied to all of the display electrodes DI continuously during the display period $T_d$ for a group of electrodes. Prior to an application of the scan pulses SP for sub-field 1 (SF1) at t0, a D-reset pulse DRP and S-reset pulse SRP are applied simultaneously to the display electrodes A and to a scan electrode A1 in order to reset the wall-charge conditions for all the discharge cells on line A1.

Shortly after the generation of these pulses, a write pulse WP is applied to the scan electrode A1 and serves to ignite all of the discharge cells on that line. The time slot of 10 μs between t0 and t1 is the address period $T_a$A for a group A and is assigned to the scan pulses SP for the scan electrodes A1–A30. The second time slot $T_a$B of 10 μs starting from t1 is assigned to the scan pulses SP for the scan electrodes B1–B30.

As should be appreciated, during the reset/write period $T_{rp}$ the reset pulses DRP, SRP and write pulse WP on the scan electrode are provided only to SF1. For the remaining sub-fields, the display pulses DP belonging to the previous sub-field act as the reset/write discharges for the following sub-field and this serves to speed up the addressing. That is in order to ignite SF2, SF1 first has to be ignited. In order to ignite SF208, then all the sub-fields between 1 and 207 first have to be ignited. In order to properly express gray tones, an erase address technique is employed in which a cell is erased, whenever the cell should stop emitting light in the remaining of the 208 subfield. This erasing is done during the address period $T_a$: a row of cells is selected via the scan pulse SP applied to the scan electrode SC of that row. For each cell in the row a data pulse DAP is applied to the data electrode DA whenever the light emission of that cell needs to be terminated in the concerned subfield. The point at which such termination occurs then serves to determine which grey tone level is displayed.

An application of the D-reset pulse DRP to the display electrodes B is delayed from that on the display electrodes A by 10 μs. The bold slanted line passing across the scan electrodes A1 and A2 connects the S-reset pulses SRP, indicating the timing of the scanning operation. The scanning direction for the scan electrodes A1 through A30 is downwards, whereas the direction for the scan electrodes B1 through B30 is upwards. The direction for C1 through C30 is downward again. Such as arrangement advantageously serves to eliminate the discontinuity of the displayed images across the groups.

In the drive scheme proposed here, scan pulses SP and data pulses DAP can advantageously be applied for addressing throughout the TV field period and regardless of the application of the display pulses DP. Also by effectively utilizing the priming effect of the reset discharges, the pulses for the addressing can be made as narrow as 0.33 μs . This allows for addressing to occur 49,920 times within a TV field and so provides 208 sub-fields for a VGA panel with 480 horizontal lines in a double-scan mode. Also the display pulses could be applied to the panel for 99% of the TV-field time.

A 21-inch diagonal AC-PDP was successfully driven with the present scheme. Luminance of 600 cd/m2 and dark room contrast of greater than 600:1 were obtained. Although not illustrated in the timing charts of FIGS. 5 and 6, the parameter $T_{rs}$ can be shortened to 5 μs by dividing the panel into 16 groups. In the manner, the data voltage Vdata was reduced to 20V with a scan pulse width $\tau_s$ of 0.33 μs.

FIG. 7 illustrates a display apparatus 10 embodying the present invention and which comprises arrangements, in this illustrated embodiment, for driving a plasma display panel as discussed further below. The apparatus includes an input 2 from which a picture signal 4 and signalization signal 6 are obtained, the signal 4 being delivered to a signal processor 18 for onward delivery to a data pulse timing generator 20. The data pulse timing generator 20 then supplies a signal to a column driver 22 for onward delivery to a plasma display panel 24 which is formed by a matrix of individual discharge cells 26.

With particular relevance to the present invention, the signalization signal 6 is delivered to a timing generator 27 having an output connected both to the signal processor 18 and also to a pair of timing generators comprising a reset pulse timing generator 28 and display pulse timing generator 30.

This pair of timing generators 28, 30 delivers respective signals to a multiplexer 32 which then delivers a multiplexer signal to a row driver 34 which, in combination with the column driver 22 serves to drive each of the discharge cells 26 of the plasma display panel 24.

In accordance with the present invention the display pulse timing generator 30 serves to deliver display pulses for driving each of the cells 26 as required and wherein the reset pulse timing generator 28 serves to allow for the development of priming charges for the discharge cells 26 from reset discharges to thereby advantageously reduce the data voltage required for the signal driving the plasma display panel 24. It will of course be appreciated that the embodiment illustrated in FIG. 7 can be adapted so as to include means arranged to operate in accordance with any aspects of the method defined herein.

FIG. 8 shows electrode connections arranged for lowering the EMI. This embodiment of the present invention has electrodes of the first 30 odd row of cells associated with a first group A. The scan electrodes SC A1 . . . A30 of these first 30 odd rows have terminals at a first side of the display panel. The interconnected display electrodes DI A of these first 30 odd rows are interconnected and have a terminal at a second side of the display panel opposing the first side. The first 30 even rows of cells are associated with another group E, having scan electrodes SC E1 . . . E30 with terminals at the second side and interconnected display electrodes DI E with a terminal at the first side.

In a driving scheme according to FIG. 6 with an address period $T_aA$, $T_aB$, . . . $T_aH$ of 10 μs and a display cycle period $T_{dc}$ of 4 μs, display pulses of group E are shifted by 4 address periods of 10 μs, so in total by 40 μs with respect to the display pulses of group A. This is exactly 40/4=10 cycles of the display pulses. So the display pulses of group A and E have substantially the same timing. Consequently, currents flowing as a result of the display pulses DP through two adjacent electrodes associated with respectively group A and E will have the same timing, however are flowing in opposite direction. This will reduce EMI because the electromagnetic fields generated by the two adjacent electrodes will compensate each other.

Likewise pairs are formed of groups B and F, C and G, D and H, resulting in compensation of electromagnetic fields across all rows of cells of the display panel.

An alternative to the embodiment as described above is to have in FIG. 8 all terminals of the display electrodes DI at the first side and all scan electrodes SC at the second side. By applying to adjacent electrodes the same pulses but with opposite polarity the same compensation effect is obtained.

In the scheme of FIG. 9 the odd rows A1, A3, A5, A29 of group A have the subfield1 SF1 starting near the start of the TV-field period $T_F$. The even rows A2, A4, A6, . . . A30 have the subfield1 SF1 starting near the middle of the TV field period $T_F$. Furthmore the subfield1 SF1 of subsequent odd rows within the group A are shifted by the length of one subfield SF being 80 μs in the embodiment shown in FIG. 5. Likewise the subfield1 SF1 of subsequent even rows is shifted. By starting the subfield1 of the first two rows B1, B2 of group B at substantially the same time as the subfield1 SF1 of the last two rows A29, A30 of group A, a discontinuity between group A and B is avoided, thereby avoiding possible visible artifacts. In group B the start of the subfield1 SF1 of subsequent rows is shifted in an opposite direction compared to group A.

When expanding above approach to all other pairs of groups C, D up to and including B', A' (as shown in FIG. 4) the starting points of the subfield1 SF1 of the rows of the display follow a zig-zag pattern.

Alternatively to above disclosed zig-zag pattern the start of the subfield1 SF1 of odd, respectively the even rows can be shifted by the length of one subfield SF for all subsequent odd, respectively even rows of the display as shown in FIG. 10. In this case the starting points follow a slanted line pattern.

By providing 208 sub-fields 209 gray levels were obtained and dynamic false contouring could be eliminated. Also it became possible to choose a wide range of gamma characteristics. However as mentioned, although the length of each sub-field was retained constant at 80 μs, the number of display pulses in the sub-field can be changed from, for example, zero to 40. This serves to allow for the design of various gamma characteristics. For example, finer gray scales can be provided for low luminance levels and characteristics such as S-shape are also possible.

It should be appreciated that the invention provides for a method of driving a PDP having a plurality of addressable discharge cells driven by display pulses, wherein a TV-field period is divided into a plurality of sub-fields all of which are substantially equal in time duration.

It should be further appreciated that the invention is not restricted to the specific details discussed above and can be employed with any display device offering appropriate characteristics, for example, electro luminescent displays exhibiting an intrinsic memory function.

It is possible to select the width of the address pulses, the maximum Treset-scan, and the data voltage amplitude in many combinations resulting in the 208 or in another number of subfields. It is not essential to the invention that the subfields have an equal length.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of driving a display panel having a plurality of addressable discharge cells driven by display pulses, including:

applying data pulses during a time interval between display pulses, generating priming charges for each of the discharge cells by means of reset discharges so as to reduce an amplitude of the data pulses, and providing, during a TV-field period that includes a plurality of sub-fields, at least one sub-field associated with a row of discharge cells with:

a reset/write period for generating the reset discharges via a D-reset pulse applied to display electrodes, an S-reset pulse applied to scan electrodes, and a write pulse applied to the scan electrodes, an address period, and a display period, and providing sub-fields other than the one sub-field, which other sub-fields are associated with the row of discharge cells with:

an address period, and a display period; and applying during the address period of a sub-field scan pulses to the scan electrodes one-horizontal-line-at-a-time, as well as data pulses in synchronization with the scan pulses to the data electrodes in order to create address discharges.

2. The method of claim 1, wherein the display periods for all the sub-fields include display pulses applied to the display electrodes and the scan electrodes and wherein a time separation between the write and scan pulses of the at least one sub-field is kept less than a predetermined value for all the discharge cells in the display panel.

3. The method of claim 2, wherein the time separations between the scan pulses and preceding display pulses in the other sub-fields are kept less than the predetermined value for all the discharge cells in the display panel.

4. The method of claim 2, wherein the predetermined value of the time separation does not exceed 10 microseconds.

5. The method of claim 2, wherein the predetermined value of the time separation does not exceed 20 microseconds.

6. The method as claimed in claim 2 and including the step of controlling a timing of a final display pulse in each sub-field such that a time period to a subsequent scan pulse is substantially constant.

7. The method of claim 1, wherein the display periods for the sub-fields include display pulses applied to the display and the scan electrodes and wherein the address period is delayed with at least one cycle of the display pulses.

8. The method of claim 1, wherein the display periods for all the sub-fields include display pulses applied to the display electrodes and the scan electrodes and wherein the address period of a sub-field ends substantially just before the start of a first display pulse of that sub-field.

9. The method of claim 1, wherein the at least one sub-field of an odd row is shifted with respect to the at least one sub-field of an adjacent even row with substantially half of the TV-field period.

10. The method of claim 1, wherein the data pulses are applied substantially continuously during the TV field period.

11. The method of claim 1 including the step of selectively varying a number of the display pulses applied during the display periods in each sub-field.

12. The method of claim 1, including the step of selectively varying a phase of the display pulses applied during the display period in each sub-field.

13. The method of claim 1 wherein a timing of respective first sub-fields on consecutive scan electrodes differs by a time period substantially equal to a length of the sub-field.

* * * * *